US006938689B2

(12) United States Patent
Farrant et al.

(10) Patent No.: US 6,938,689 B2
(45) Date of Patent: Sep. 6, 2005

(54) COMMUNICATING WITH A TOOL

(75) Inventors: Simon L. Farrant, Houston, TX (US); Nolan C. Lerche, Stafford, TX (US); James E. Brooks, Manvel, TX (US); Edward H. Rogers, Bookside Village, TX (US); Michael L. Timmons, Missouri City, TX (US); Anthony F. Venersuo, Missouri City, TX (US)

(73) Assignee: Schumberger Technology Corp., Sugar Land, TX (US)

( * ) Notice: Subject to any disclaimer, the term of this patent is extended or adjusted under 35 U.S.C. 154(b) by 255 days.

(21) Appl. No.: 09/997,021

(22) Filed: Nov. 28, 2001

(65) Prior Publication Data

US 2002/0062991 A1 May 30, 2002

Related U.S. Application Data

(63) Continuation-in-part of application No. 09/179,507, filed on Oct. 27, 1998, now Pat. No. 6,283,227.

(51) Int. Cl.[7] ..... E21B 47/00
(52) U.S. Cl. ..... 166/66; 166/250.01
(58) Field of Search ..... 175/4.54, 4.55; 102/215, 217; 361/249; 166/297, 55.1, 65.1, 66, 250.01, 72

(56) References Cited

U.S. PATENT DOCUMENTS

| | | | |
|---|---|---|---|
| 3,181,463 | A | 5/1965 | Morgan et al. |
| 3,327,791 | A | 6/1967 | Harrigan, Jr. |
| 3,366,055 | A | 1/1968 | Hollander, Jr. |

(Continued)

FOREIGN PATENT DOCUMENTS

| | | | |
|---|---|---|---|
| EP | 0 029 671 | | 9/1983 |
| EP | 0 601 880 | A2 | 6/1994 |
| EP | 0 604 694 | A1 | 7/1994 |
| GB | 677824 | | 8/1952 |
| GB | 693164 | | 6/1953 |
| GB | 2118282 | A | 10/1983 |
| GB | 2100395 | B | 8/1984 |
| GB | 2190730 | A | 11/1987 |
| GB | 2226872 | A | 7/1990 |
| GB | 2265209 | A | 9/1993 |
| GB | 2290855 | A | 1/1996 |
| WO | WO 96/23195 | | 8/1996 |
| WO | WO 98/38470 | | 9/1998 |
| WO | WO 01/59401 | * | 8/2001 |

OTHER PUBLICATIONS

"Performance Criteria for Small Slapper Detonators" Controller, Her Majesty's Stationery Office, London 1984.

"New Developments in the Field of Firing Techniques" by K. Ziegler Propellants, Explosives, Pyrotechnics 12, 115–120 (1987).

"Application of Slapper Detonator Technology to the Design of Special Detonation Systems," by W. H. Meyers Proc. 12$^{th}$ Symposium on Explosives and Pyrotechnics, San Diego, California, Mar. 13–15, 1984, Detonation Systems Development, Los Alamos National Laboratory, pp. 4–5 through 4–19.

"CP DDT Detonators: II. Output Characterization," by M. L. Lieberman Sandia National Laboratories Report SAND 83–1893, Albuquerque, New Mexico, pp. 3–105 through 3–112.

(Continued)

*Primary Examiner*—Sunil Singh
(74) *Attorney, Agent, or Firm*—Trop, Pruner & Hu, P.C.; Bruan P. Galloway; Jaime A. Castano

(57) ABSTRACT

A system includes a user interface device that is capable of communicating wirelessly with a tool. In one example arrangement, the tool can be a well tool or a tool having one or more explosive components. The user interface device is adapted to send commands to the tool to perform tasks, such as test operations. In one arrangement, the user interface device is a personal digital assistant (PDA) having a graphical user interface (GUI).

22 Claims, 15 Drawing Sheets

U.S. PATENT DOCUMENTS

| | | | | | |
|---|---|---|---|---|---|
| 3,517,758 | A | | 6/1970 | Schuster | |
| 3,640,224 | A | | 2/1972 | Petrick et al. | |
| 3,640,225 | A | | 2/1972 | Carlson et al. | |
| 3,978,791 | A | | 9/1976 | Lemley et al. | |
| 4,137,850 | A | | 2/1979 | Donner | |
| 4,307,663 | A | | 12/1981 | Stonestrom | |
| 4,393,779 | A | | 7/1983 | Brede et al. | |
| 4,421,030 | A | | 12/1983 | DeKoker | |
| 4,422,381 | A | | 12/1983 | Barrett | |
| 4,441,427 | A | | 4/1984 | Barrett | |
| 4,471,697 | A | | 9/1984 | McCormick et al. | |
| 4,517,497 | A | | 5/1985 | Malone | |
| 4,527,636 | A | | 7/1985 | Bordon | |
| 4,592,280 | A | | 6/1986 | Shores | |
| 4,602,565 | A | | 7/1986 | MacDonald et al. | |
| 4,632,034 | A | | 12/1986 | Colle, Jr. | |
| 4,638,712 | A | | 1/1987 | Chawla et al. | |
| 4,662,281 | A | | 5/1987 | Wilhelm et al. | |
| 4,700,629 | A | | 10/1987 | Benson et al. | |
| 4,708,060 | A | | 11/1987 | Bickes, Jr. et al. | |
| 4,729,315 | A | | 3/1988 | Proffit et al. | |
| 4,735,145 | A | | 4/1988 | Johnson et al. | |
| 4,762,067 | A | | 8/1988 | Barker et al. | |
| 4,777,878 | A | | 10/1988 | Johnson et al. | |
| 4,788,913 | A | | 12/1988 | Stroud et al. | |
| 4,831,933 | A | | 5/1989 | Nerheim et al. | |
| 4,843,964 | A | | 7/1989 | Bickes, Jr. et al. | |
| 4,886,126 | A | | 12/1989 | Yates, Jr. | |
| 4,944,225 | A | | 7/1990 | Barker | |
| 5,088,413 | A | | 2/1992 | Huber et al. | |
| 5,094,166 | A | | 3/1992 | Hendley, Jr. | |
| 5,094,167 | A | | 3/1992 | Hendley, Jr. | |
| 5,172,717 | A | * | 12/1992 | Boyle et al. | 137/155 |
| 5,347,929 | A | | 9/1994 | Lerche et al. | |
| 5,413,045 | A | | 5/1995 | Miszewski | |
| 5,505,134 | A | | 4/1996 | Brooks et al. | |
| 5,520,114 | A | | 5/1996 | Guimard et al. | |
| 5,539,636 | A | | 7/1996 | Marsh et al. | |
| 5,706,892 | A | | 1/1998 | Aeschbacher, Jr. et al. | |
| 5,756,926 | A | | 5/1998 | Bonbrake et al. | |
| 5,895,906 | A | | 4/1999 | Danielson et al. | |
| 5,923,757 | A | * | 7/1999 | Hocker et al. | 345/156 |
| 6,008,735 | A | | 12/1999 | Chiloyan et al. | |
| 6,012,015 | A | * | 1/2000 | Tubel | 702/6 |
| 6,088,730 | A | | 7/2000 | Kato et al. | |
| 6,195,589 | B1 | | 2/2001 | Ketcham | |
| 6,500,262 | B1 | * | 12/2002 | Bednarz et al. | 118/696 |
| 6,557,636 | B2 | * | 5/2003 | Cernocky et al. | 166/297 |
| 2001/0052426 | A1 | * | 12/2001 | Mercer | 175/26 |
| 2003/0000411 | A1 | * | 1/2003 | Cernocky et al. | 102/200 |
| 2003/0001753 | A1 | * | 1/2003 | Cernocky et al. | 340/853.1 |
| 2003/0075069 | A1 | * | 4/2003 | Boucher et al. | 102/217 |

OTHER PUBLICATIONS

"A Fast, Low Resistance Switch for Small Slapper Detonators," by D. D. Richardson and D. A. Jones Department of Defense Materials Research Laboratories Report MRL–R–1030, Victoria, Australia.

"The Effect of Switch Resistance on the Ringdown of a Slapper Detonator Fireset," by D. D. Richardson Department of Defense Materials Research Laboratories Report MRL–R–1004, Victoria, Australia.

"Flyer Plate Motion and Its Deformation During Flight," by H. S. Yadav and N. K. Gupta Int. J. Impact Engng, vol. 7, No. 1, 1998, pp. 71–83.

"Mossbauer Study of Shock–Induced Effects in the Ordered Alloy $Fe_{50}Ni_{50}$ In Meteorites," By R. B. Scorzelli, I. S. Azevedo, J. Danon and Marc A. Meyers J. Phys. F: Met. Phys. 17 (1987), pp. 1993–1997.

"Effect of Shock–Stress Duration on the Residual Structure and Hardness of Nickel, Chromel, and Inconel," by L. E. Murr and Jong–Yuh Huang Materials Science and Engineering, 19 (1975), pp. 115–122.

Critical Energy Criterion for the Shock Initatiation of Explosives by Projectile Impact, by H. R. James Propellants, Explosives, Pyrotechnics 13, (1988), pp. 35–41.

"High–Temperature–Stable Detonators," by R. H. Dinegar Proc. 12$^{th}$ Symposium on Explosives and Pyrotechnics, San Diego, California, Mar. 13–15, 1984, Los Alamos National Laboratory, pp. 4–1 through 4–4.

"Shock Initiation of PETN," by J. C. Cheng Monsanto Research Corporation, Miamisburg, Ohio, pp. 1–31 through 1–35.

"Exploding Metallic Foils for Slapper, Fuse, and Hot Plasma Applications: Computational Predictions, Experimental Observations," by I. R. Lindemuth, J. H. Brownell, A. E. Greene, G. H. Nickel, T. A. Oliphant and D. L. Weiss, Thermonuclear Applications Group, Applied Theoretical Physics Division, and W. F. Hemsing and I. A. Garcia, Detonation Systems Group, Dynamic Testing Division, Los Alamos National Laboratory, Los Alamos, New Mexico, pp. 299–305.

"A New Kind of Detonator—The Slapper," by J. R. Stroud Lawrence Livermore Laboratory, University of California, Livermore, California, pp. 22–1 through 22–6.

"Pyrotechnic Ignition in Minislapper Devices," by D. Grief and D. Powell Awre. Aldermaston, Reading RG7 4PR, Berkshire, England, Controller, HMSO, London, 1981, pp. 43–1 through 43–10.

"Exploding Foils—The Production of Plane Shock Waves and the Acceleration of Thin Plates," by D. V. Keller & J. R. Penning, Jr. The Boeing Company, Seattle, Washington, pp. 263–277.

"Acceleration of Thin Plates by Exploding Foil Techniques," by A. H. Guenther, D. C. Wunsch and T. D. Soapes Pulse Power Laboratory, Physics Division, Research Directorate Air Force Special Weapons Center, Kirtland Air Force Base, New Mexico, pp. 279–298.

"A Low–Energy Flying Plate Detonator," by A. K. Jacobson Sandia National Laboratories Report, SAND 81–0487C, Albuquerque, New Mexico, 1981, pp. 49–1 through 49–20.

"Sequential Perforations in Boreholes," by H. Lechen ANTARES Datensysteme GmbH, Jan. 1998.

"A Simple Method for Estimating Well Productivity," by J. E. Brooks. SPE European Formation Damage Conference, The Hague, The Netherlands, Jun. 2–3, 1997.

"Unique Features of SCBs," by P. D. Wilcox and "SCB Explosive Studies" by R. W. Bickes, Jr. Initiating and Pyrotechnic Components Division 2515.

* cited by examiner

COMMUNICATING WITH A TOOL

CROSS REFERENCE TO RELATED APPLICATION

This is a continuation-in-part of U.S. Ser. No. 09/179,507, filed Oct. 27, 1998, now U.S. Pat. No. 6,283,227.

TECHNICAL FIELD

The invention relates to communicating with a tool.

BACKGROUND

To complete a well, one or more sets of perforations may be created downhole using perforating guns. Such perforations allow fluid from producing zones to flow into the wellbore for production to the surface. To create perforations in multiple reservoirs or in multiple sections of a reservoir, multi-gun strings are typically used. A multi-gun string may be lowered to a first position to fire a first gun or bank of guns, then moved to a second position to fire a second gun or bank of guns, and so forth.

Selectable switches are used to control the firing sequence of the guns in the string. Simple devices include dual diode switches for two-gun systems and percussion actuated mechanical switches or contacts for multi-gun systems. A percussion actuated mechanical switch is activated by the force from a detonation. Guns are sequentially armed starting from the lowest gun, using the force of the detonation to set a switch to complete the circuit to the gun above and to break connection to the gun below. The switches are used to step through the guns or charges from the bottom up to select which gun or charge to fire. Some systems allow certain of the switches to be bypassed if failure occurs.

Other operations can also be performed in a well with other types of tools. As tools become more technologically sophisticated, electronic components are added. To date, however, a convenient and flexible device has conventionally not been provided to communicate with or to test the various types of tools.

SUMMARY

In general, according to one embodiment, a system comprises a user interface device and a tool selected from the group consisting of a well tool and a tool containing one or more explosive components. The user interface device is adapted to communicate wirelessly with the tool.

In general, according to another embodiment, a system for testing a tool includes a user interface device and a test system adapted to be coupled to the tool. The user interface device is adapted to communicate wirelessly with the test system and to send commands to the test system for testing the tool.

Other or alternative features will become apparent from the following description, from the drawings, and from the claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and downwardly"; "below" and "above"; and other like terms indicating relative positions above or below a given point or element are used in this description to more clearly describe some embodiments of the invention. However, when applied to equipment and methods for use in wells that are deviated or horizontal, or when applied to equipment and methods that when arranged in a well are in a deviated or horizontal orientation, such terms may refer to a left to right, right to left, or other relationships as appropriate.

Figure 1:
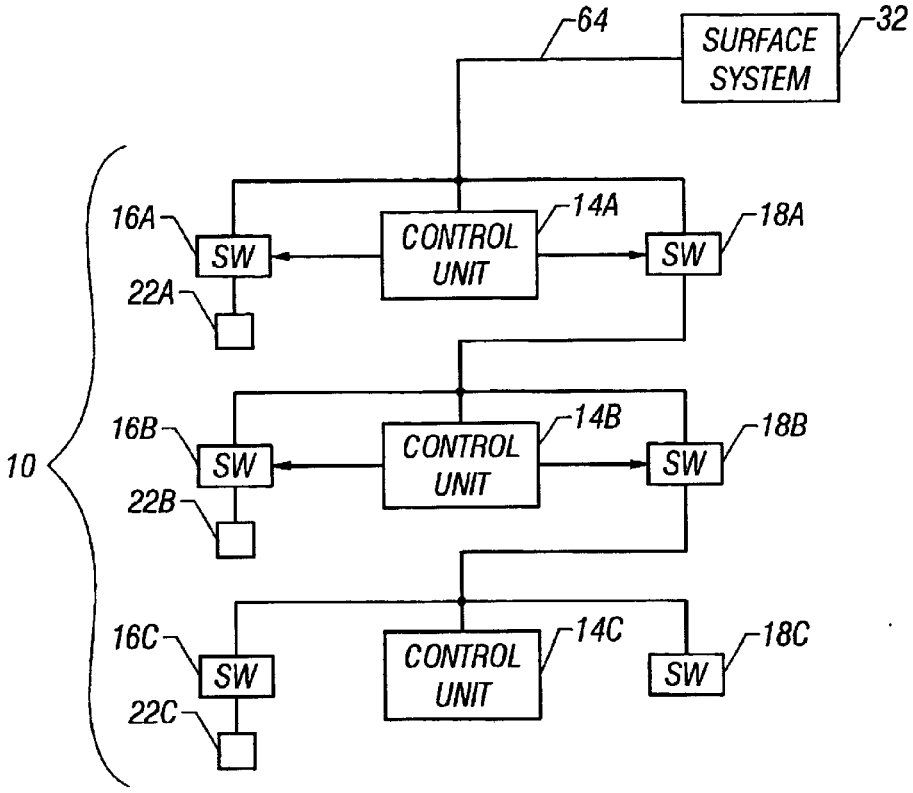
FIG. 1 is a diagram of an example system including a tool string and a surface system.

Referring to FIG. 1, a perforating system 10 according to an embodiment of the invention for use in a well is illustrated. Note that the arrangement shown in FIG. 1 is an operational arrangement of the perforating system 10 in which detonating devices 22A, 22B, and 22C are included. A larger or smaller number of devices can be used in other embodiments. As described further below, in a test arrangement, the detonating devices 22A, 22B, and 22C are not necessarily included in the perforating system 10. In some arrangements, the detonating devices are left out, while in other arrangements, the detonating devices are left in the perforating system 10.

The perforating system 10 in the illustrated embodiment includes a multi-gun string having a control system that includes multiple control units 14A–14C to control activation of guns or charges in the string. Each control unit 14 may be coupled to switches 16 and 18 (illustrated as 16A–16C and 18A–18C). Cable switches 18A–18C are controllable by the control units 14A–14C, respectively, between on and off positions to enable or disable current flow through one or more electrical cables 64 (which may be located in a wireline or coiled tubing, for example) to successive control units.

The detonating switches 16A–16C are each coupled to a respective detonating device 22 (illustrated as 22A–22C) that may be found in a perforating gun, for example. The detonating device 22 may be an electro-explosive device (EED) detonator (e.g., an explosive foil initiator (EFI) detonator, exploding bridgewire (EBW) detonator, semiconductor bridge detonator, a hot-wire detonator, etc.), or other type of detonator coupled to initiate a detonating cord to fire shaped charges or other explosive devices in the perforating gun. If activated to an on position, a switch 16 allows electrical current to flow to a coupled detonating device 22.

Although described in the context of a perforating gun, other embodiments include other types of tools for performing other operations in a wellbore. Such other tools can also have multiple switches for controlling multiple devices, for example, a release head, core sampling tool, and so forth.

In the illustrated embodiment, the cable switch 18A controls current flow to the control unit 14B, and the cable switch 18B controls current flow to the control unit 14C.

The one or more electrical cables 64 extend through a wireline, coiled tubing, or other carrier to surface equipment. The surface equipment includes a surface system 32, which can either be a tester system (for testing the perforating system 10) or an activation system (to activate the perforating system 10 during well operations). A tester system is described further below. An activation system is configurable by tool activation software to issue commands to the perforating system 10 to set up and to selectively activate one or more of the control units 14.

Bi-directional electrical communication (by digital signals or series of tones, for example) between the surface system 32 and control units can occur over the one or more of the electrical cables 64.

In one embodiment of the invention, each control unit 14 may be assigned an address by the surface system 32 during system initialization or testing. In other embodiments, the control units 14 may be hard coded with pre-assigned addresses or precoded during assembly. Additional information may be coded into the control units, including the type of device, order number, run number, and other information.

Figure 2:
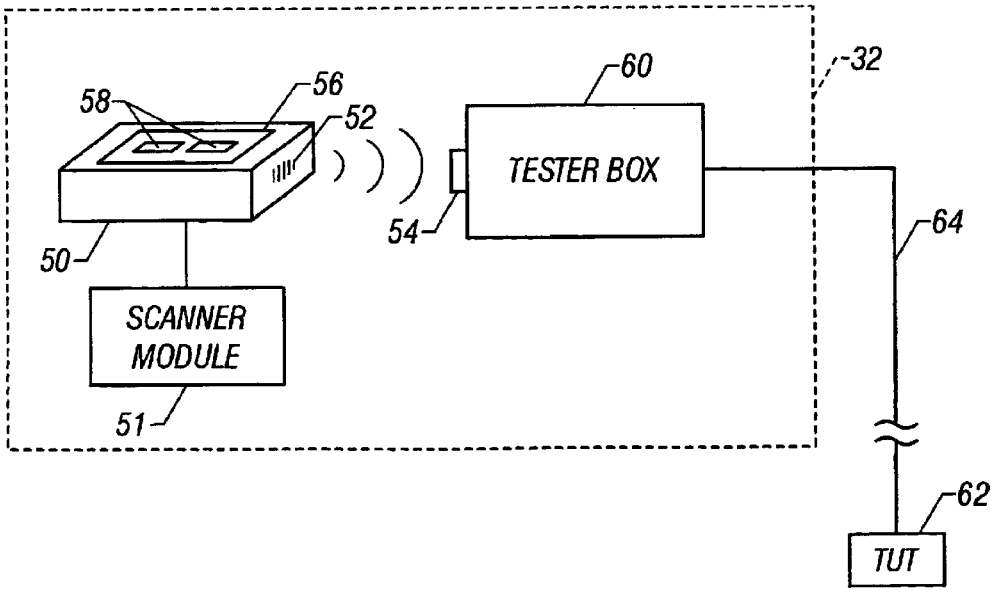
FIG. 2 is a block diagram of a tester system useable in the system of FIG. 1.

Referring to FIG. 2, an arrangement of the surface system 32 that includes a tester box 60 and a portable user interface device 50 is illustrated. This arrangement is used to test the components of a tool under test 62 (e.g., the perforating system 10). The tester box 60 is coupled to the tool under test 62 over the electrical cable 64. Note that during testing, the tool under test 62 can be located at the surface, such as in a test facility, laboratory, and so forth. Alternatively, the tool under test 62 is located downhole in a wellbore.

The tester box 60 includes a communications port 54 that is capable of performing wireless communications with a corresponding port 52 on the portable user interface device 50. In one embodiment, the communications ports 52 and 54 are capable of performing infrared (IR) communications. In an alternative embodiment, radio frequency (RF) or other forms of wireless communications are performed between the portable user interface device 50 and the tester box 60. Such wireless communications occur over a wireless link between the user interface device 50 and the tester box 60. In yet another arrangement, a wired connection is provided between the user interface device 50 and the tester box 60.

One example of the user interface device 50 is a portable digital assistant (PDA), such as PALM™ devices, WINDOWS® CE devices, or other like devices. Alternatively, the user interface device 50 can be a laptop computer. The user interface device 50 includes a display 56 for displaying information to the user. In one embodiment, various graphical user interface (GUI) elements 58 (e.g., windows, screens, icons, menus, etc.) are provided in the display 56. The GUI elements include control elements, such as menu items or icons that are selectable by the user to perform various acts. The GUI elements 58 also include display boxes or fields in which information pertaining to the tool under test 62 is displayed to the user.

A benefit of using the user interface device 50 is that a custom user interface can be developed relatively conveniently. The user interface is provided by application software loaded onto the user interface device 50. For example, if the user interface device 50 includes a WINDOWS® CE operating system, then software applications compatible with WINDOWS® CE can be developed and loaded onto the user interface device 50. By using an off-the-shelf user interface device 50, special-purpose hardware devices for testing the tool under test 62 can be avoided. By using the user interface device 50, flexibility is enhanced since application software can be quickly modified to suit the needs of users.

Also, due to safety regulations, a user interface device that is relatively small in size can be easily encapsulated in an outer cover or membrane. The outer cover or membrane is used to control (that is, reduce) discharge of static electricity, or other electrical impulse, which can pose a safety hazard at a wellsite.

In response to user selection of various GUI elements 58, the user interface device 50 sends commands to the tester box 60 through the wireless communications ports 52 and 54. The commands cause certain tasks to be performed by control logic in the tester box 60. Among the actions taken by the tester box 60 is the transmission of signals over the cable 64 to test the components of the tool under test 62. Feedback regarding the test is communicated back to the tester box 60, which in turn communicates data over the wireless medium to the user interface device 50, where the information is presented in the display 56.

In other arrangements, the user interface device 50 can be used for tasks other than testing tasks. For example, instead of a tool under test, element 62 of FIG. 2 can be an actual tool ready to perform a downhole operation. Also, instead of a tester box, the element 60 of FIG. 2 can be an activation system. In these arrangements, the user interface device 50 sends commands to the activation system for activating the tool in response to user selections received at the user interface device 50. In one example, the activated tool is a well tool for performing various well operations (e.g., logging, perforating, production, flow control, measuring, etc.). A "well tool" also refers to any tool or system that can be used at the well surface (e.g., control system at a well site, and so forth). In another example, the activated tool includes a tool having one or more explosive elements for various types of applications (e.g., well perforating, mining, seismic acquisition, core sampling, surface demolition, armaments, and so forth).

Figure 3:
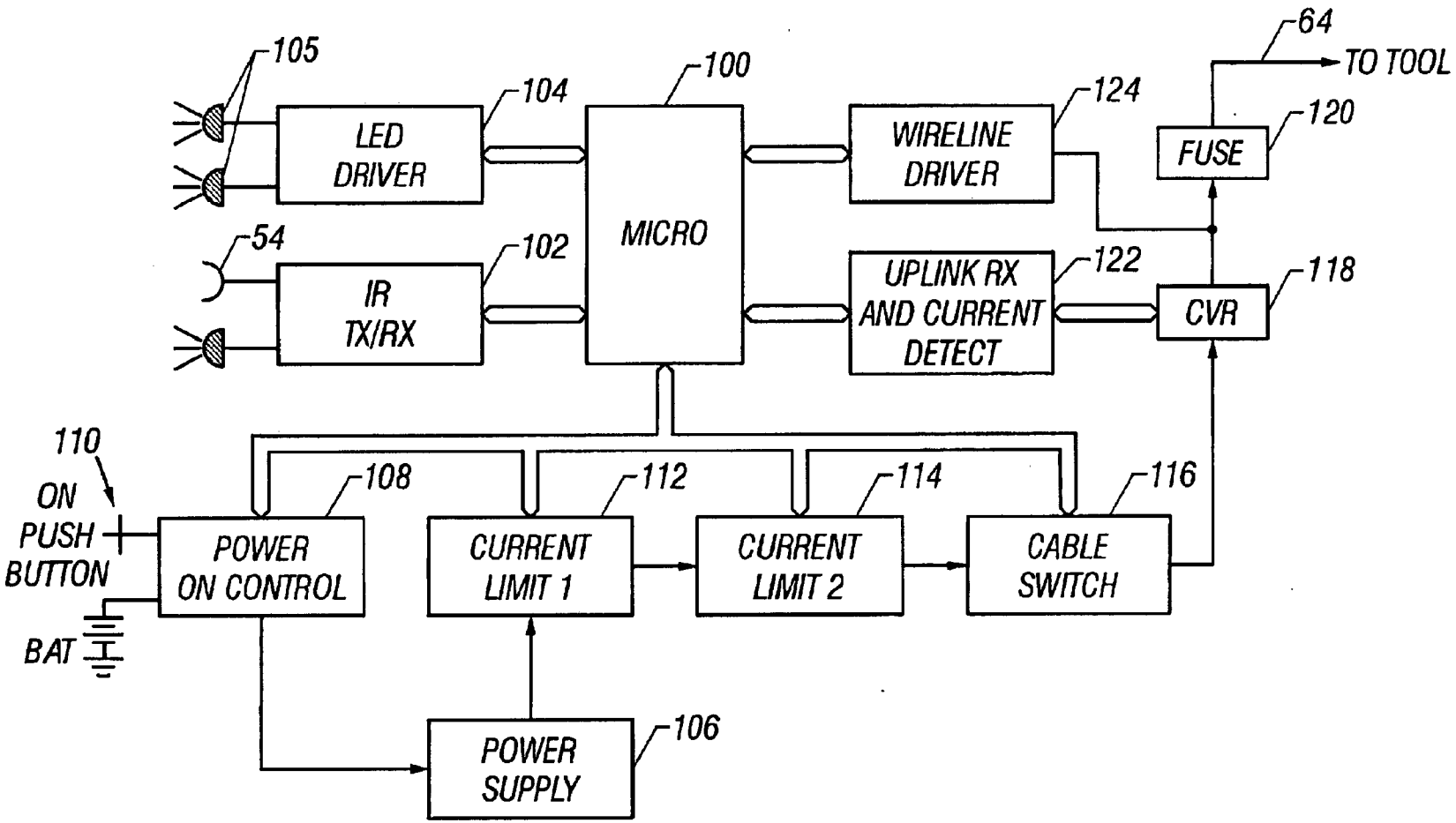
FIG. 3 is a block diagram of a tester box that is part of the tester system of FIG. 2.

FIG. 3 shows one example arrangement of components in the tester box 60. A controller in the tester box 60 is implemented as a microcontroller 100. The microcontroller 100 is preprogrammed to perform certain tasks in response to various stimuli (e.g., commands received from the user interface device through a transceiver 102). In one embodiment, the transceiver 102 is an IR transceiver to receive IR signals. Alternatively, the transceiver 102 can be other types of transceivers, such as RF transceivers and so forth.

In one example arrangement, the microcontroller 100 is also connected to a light emitting diode (LED) driver 104 that is connected to one or more LEDs 105. The LEDs are provided as indicators to the user of various events (active power, low battery, over-current detection, and other activities) going on in the tester box 60.

Power to the tester box 60 is provided by a power supply 106. Note that the power supply 106, although shown as a single component, can actually be implemented as plural components to provide different power supply voltage levels as needed by the circuitry of the tester box 60. The power supply 106 is connected to a power control circuit 108, which causes activation or deactivation of the power supply 106. The power control circuit 108 is connected to a button 110, which can be activated by the user to turn the tester box 60 on or off. Also, an automatic timeout feature can be included to shut off power after some period of inactivity.

Alternatively, instead of a button 110, the power control circuit 108 is connected to a detector (not shown) that is able to detect an external stimulus. For example, the detector can be an optical detector to detect for the presence of a bar code (such as a bar code on the badge of an authorized user). Other types of detectors can be used in other embodiments. Such other detectors include components to interact with a "smart" card, which is basically a card with an embedded processor and storage. Alternatively, another type of detector includes a radio frequency (RF) or other wireless detector to communicate with an external device.

Security can be provided by at the user interface device by requiring input of a password before access is granted to the user interface device. For example, the user interface device has a field to accept and receive a user-input password. Alternatively, the user interface device may be configured to have a component to detect a smart card so that access is granted only in response to detection of the smart card of an authorized user. With the password or smart card arrangement, a hierarchy of security levels can be provided, with an engineer having a higher level of access (access to more features) than a technician, for example. Only an authorized user interface device is able to interact or communicate with the safety box.

The power supply 106 is connected through current limit devices 112 and 114. For added safety and redundancy, two current limit devices 112 and 114 are used. The current limit devices 112 and 114 are designed to limit the maximum current that can be passed to the tool under test 62 over the electrical cable 64. In one example, the maximum current that can be passed through each of the current limit devices 112 and 114 is 25 milliamps (mA). However, in other embodiments, other current limits can be set.

The output of the current limit device 114 is connected to a switch 116, which controls whether the output of the current limit device 114 is connected to one input of a current viewing resistor 118. The cable switch 116 is controlled by the microcontroller 100. In one embodiment, the microcontroller 100 does not close the switch 116 until the microcontroller 100 has determined that current levels are within predefined limits. Assuming the switch 116 is closed, current flows from the current limit device 114 through the current viewing resistor 118 and an optional fuse 120 to the cable 64. The fuse 120 is an optional added safety element for limiting the maximum current that can flow to the cable 64. If the current exceeds a maximum threshold, then the fuse 120 will blow to prevent accidental activation of the tool under test 62. This is particularly beneficial if the tool under test 62 can potentially include explosive devices that may have been left in the tool inadvertently. By limiting the current to a level below that needed to activate the explosive devices, safety is enhanced.

An uplink receive and current detect circuit 122 is connected to the current viewing resistor 118. Current passing through the current viewing resistor 118 causes a voltage to be developed across the resistor. This voltage is converted by an amplifier in the current detect circuit 122 to a voltage level provided to the microcontroller 100. Based on the received voltage level, the microcontroller 100 is able to calculate the amount of current passed through the current viewing resistor 118.

The microcontroller 100 is also connected to a driver 124, whose output is connected through the fuse 120 to the cable 64. The driver 124 drives coded signals down the cable 64 to perform various test operations.

Figure 4:
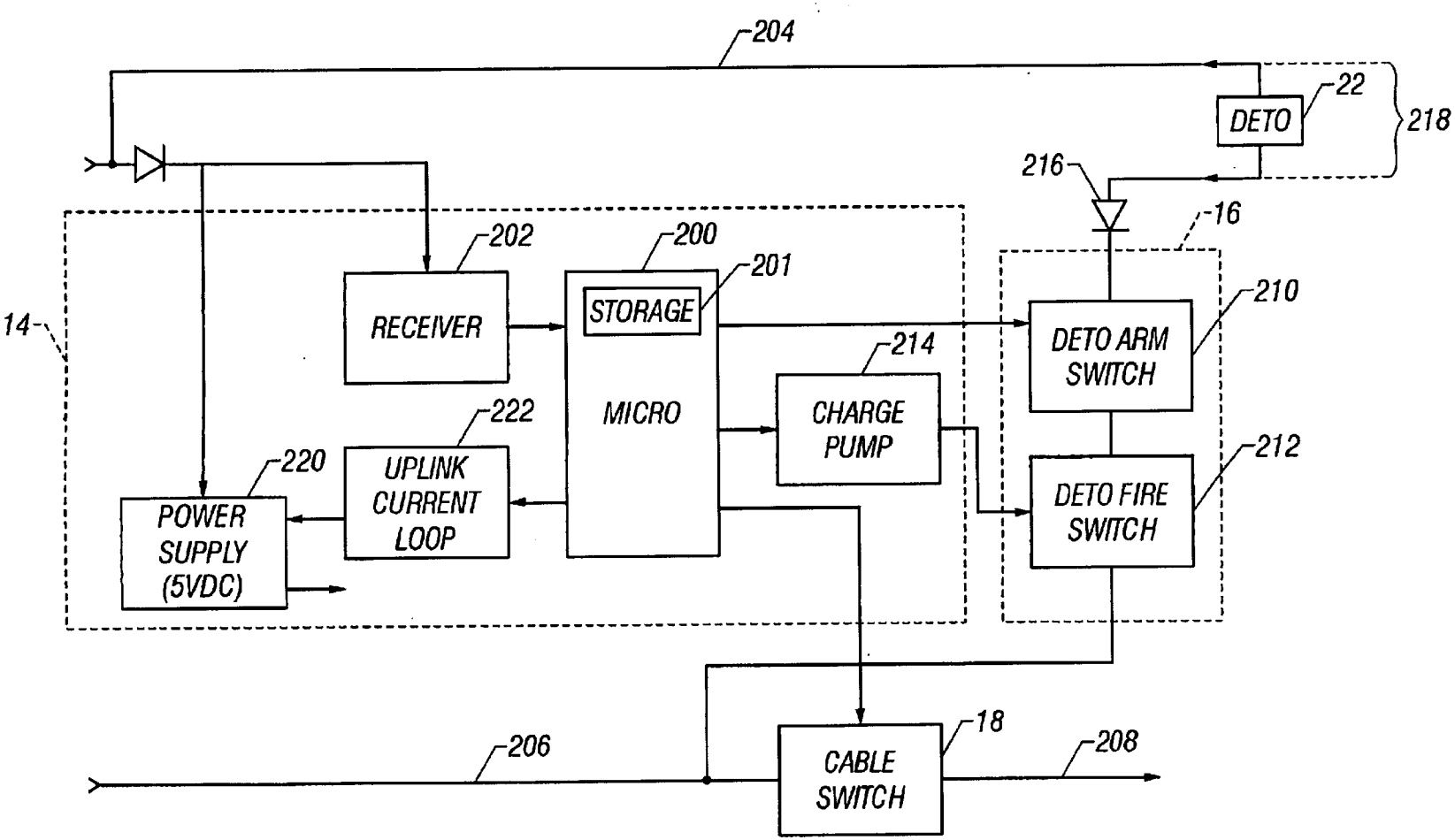
FIG. 4 is a block diagram of a control system used in the tool string of FIG. 1.

Circuitry in the tool under test 62 in accordance with one example embodiment is illustrated in FIG. 4. The circuitry includes the control unit 14, which contains a microcontroller 200 programmed to perform various tasks. Note that the tool under test 62 may include multiple control units 14, as shown in FIG. 1. The microcontroller 200 is connected to a receiver circuit 202, which receives signals over a line 204. The signals received by the receiver circuit 202 include commands from the tester system 32 for activating the microcontroller 200 to perform test operations. The line 204 in one example arrangement is the ground line.

Another line 206 is connected to one side of the cable switch 18, with the other side of the cable switch 18 connected to another line 208. When the cable switch 18 is opened, the lines 206 and 208 (which are portions of the cable 64) are isolated. The cable switch 18 is controlled by the microcontroller 200. When activated to a closed position by the microcontroller 200, the cable switch 18 electrically connects the lines 206 and 208.

The microcontroller 200 also controls activation of the detonator switch 16, which includes an arm switch 210 and a fire switch 212. The arm switch 210 is controlled by a signal from the microcontroller 200, while the fire switch 212 is controlled by a signal from a charge pump 214. The input of the charge pump 214 is connected to an output of the microcontroller 200. The charge pump 214 is designed to increase the voltage of the signal output provided by the microcontroller 200 so that an increased voltage level is provided to the fire switch 212. In an alternative embodiment, the increased voltage level is provided directly from the microcontroller 200. In yet another embodiment, the fire switch 212 is activated by the same voltage level as the arm switch 210. As yet another alternative, only one switch (instead of two switches 210 and 212) is used.

The switch 16 is connected to the detonator device 22 through a diode 216. When the arm switch 210 and fire switch 212 are both closed, a current path is provided between lines 204 and 206. If a sufficient voltage difference exists between lines 204 and 206, then the detonator device 22 is activated.

As noted above, in a test arrangement, the detonator device 22 may be removed. In place of the detonator device 22 is a short circuit connection 218.

Power to the control unit 14 is provided by a power supply 220. The power supply 220 outputs supply voltages to the various components of the control unit 14. Also included in the control unit 14 is an uplink control loop 222, which is designed to sink a predetermined amount of current. One purpose of the uplink current loop 222 is to enable a predetermined amount of current to be induced in the line 206 when the control unit 14 is connected to the cable 64 so that the tester box 60 is able to detect that a control unit load has been added to the cable 64. This is useful for testing whether cable switches 18 are operational in connecting the control unit 14 to the cable 64. Thus, if a cable switch 18 has been activated closed, but it has failed to do so due to a defect, then the additional current load from the next control unit 14 in the tool under test 62 will not be present on the cable 64.

Another purpose of the uplink current loop 222 is to modulate the current level on the cable 64 based on a data pattern provided by the microcontroller 200. The variation in current level provides a coded signal in the uplink direction to the test box 60.

Figure 5:
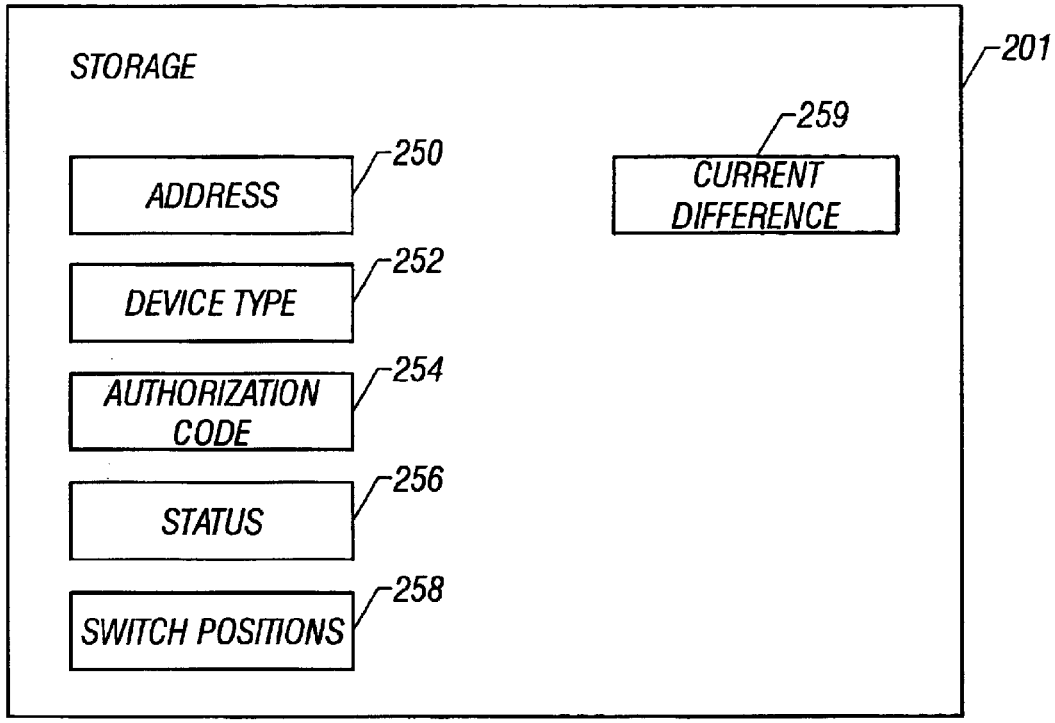
FIG. 5 illustrates types of data stored in the control system of FIG. 4.

In one embodiment, the microcontroller 200 includes a storage 201 to store information. For example, as further shown in FIG. 5, the storage 201 contains the following information: an address (or other identifier) 250 of the control unit 14; a device type 252 to indicate the type of device; and an authorization code 254 which has to be received from the surface system 32 before the control unit 14 is enabled for activation. If a code matching the authorization code 254 is not received by the control unit 14, then the control unit 14 remains disabled and cannot be activated. Note, however, that this authorization feature is optional and can be omitted in some embodiments of the invention. The storage 201 also contains status information 256, which pertains to a status of the microcontroller 200. Also, the storage 201 contains information 258 pertaining to positions of switches 210, 212, and 218. In addition, the storage 201 contains information 259 pertaining to current flow difference so the presence or absence of additional devices as they are added to the cable 64 can be detected, as well as the absence or presence of detonating devices.

Figure 6:
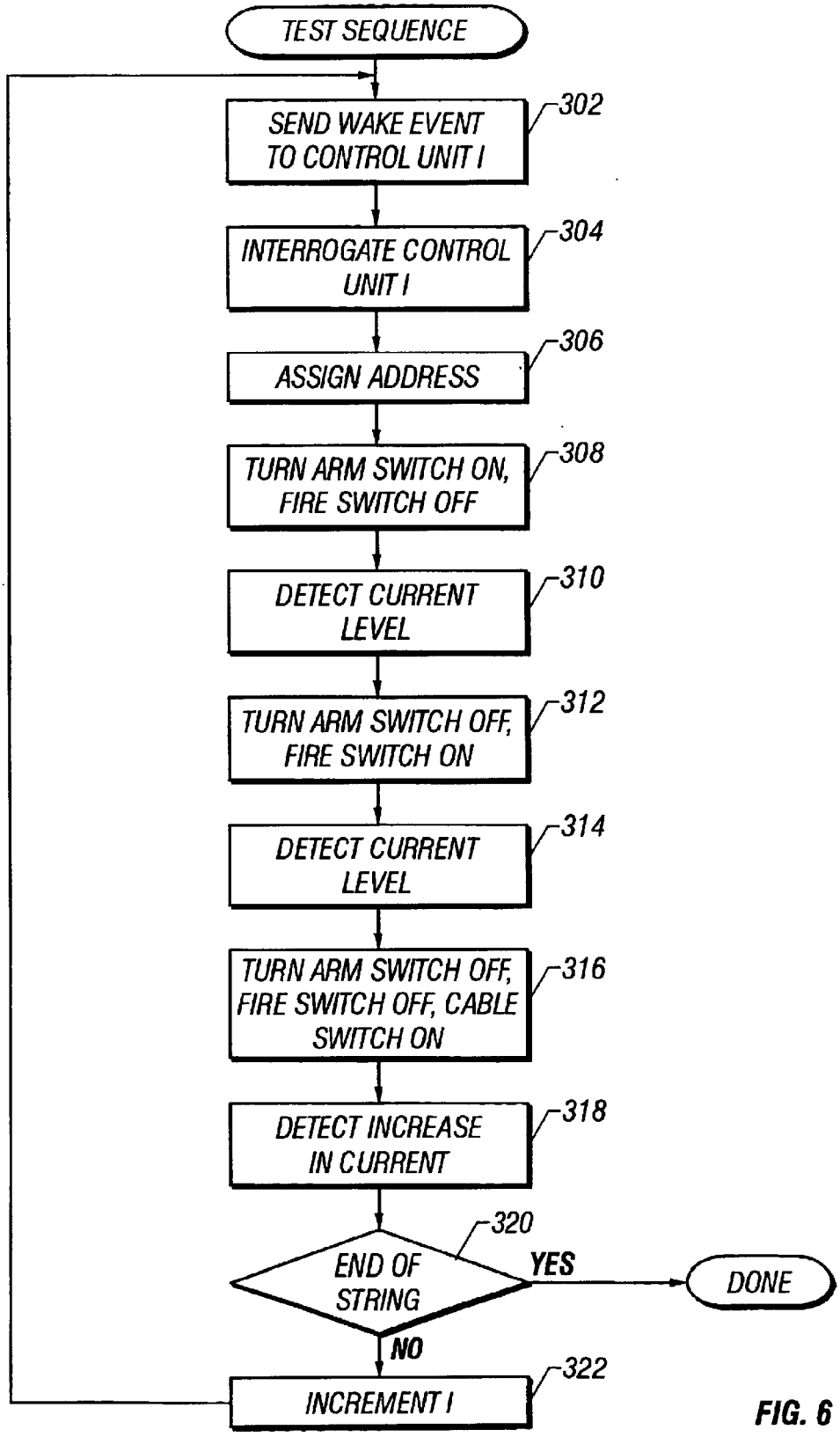
FIG. 6 is a flow diagram of a test sequence in accordance with an embodiment.

Referring to FIG. 6, a flow diagram is shown of a test sequence in accordance with an embodiment. In response to commands from the user interface device 50, the tester box 60 sends a wake event (at 302) down the electrical cable 64 to a control unit 14. In one embodiment, the uppermost control unit is the first to receive this wake event. In response to the wake event, the control unit provides feedback to the tester box. By virtue of this two-way communication, if the proper address and current levels are detected, then the cable switch is turned on, completing an electrical path to the next control unit. This process is iteratively performed until all control units 14 in the multi-tool string have been initialized. Note that during the test sequence, the tool under test is not necessarily located downhole, but can be at the surface (such as in a lab or other test environment).

The wake event is first transmitted to a control unit I, where I is initially set to the value 1 to represent the upper control unit. Whether the control unit I responds or not to the wake event is part of the power-up test. If the control unit I does not respond, then it has failed the power-up test. The tester box 60 (or user interface device 50) notes whether each of the control units have passed or failed the power-up test. The tester box 60 (under control of the user interface device 50) next interrogates (at 304) the control unit I to determine its address, positions of switches 16 and 18, and the status of the microcontroller 100. This is performed by reading the content of the storage 201 (FIG. 4).

Figure 18:
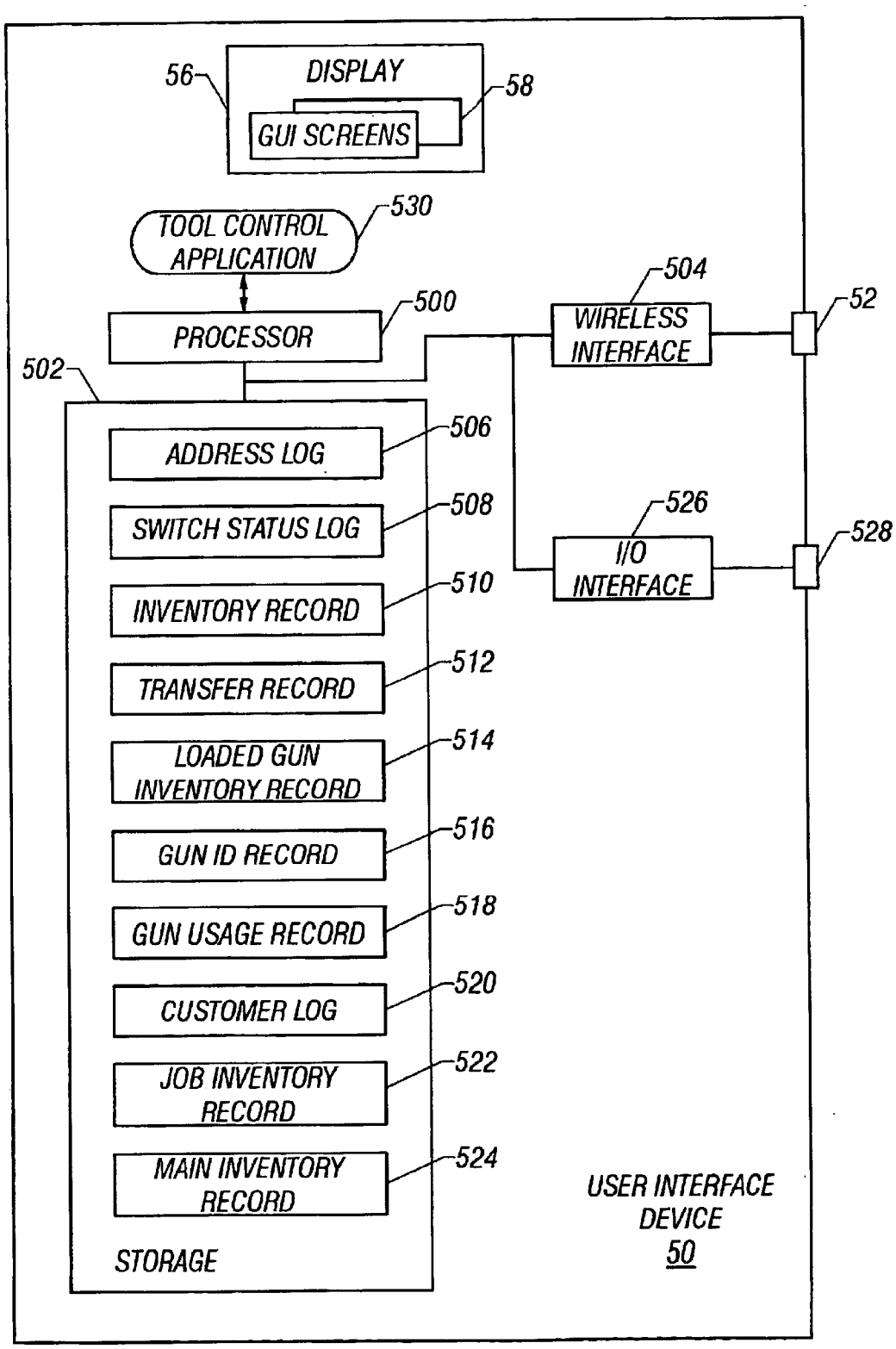
FIG. 18 is a block diagram of components in the user interface device.

Optionally, the tester box 60 (under control of the user interface device 50) is able to assign (at 306) an address to the control unit I if the control unit I has not yet been assigned an address. The address of the control unit I is communicated to the user interface device 50 for storage in an address log 506 (FIG. 18). The testing of the switches is next performed. First, the arm switch 210 is turned on (at 308), with the fire switch 212 turned off. The electrical current level is detected (at 310) by the test box 60. If a short is present in the first switch 212, then a current path exists between the lines 204 and 206, and a substantial amount of current will be detected by the test box 60. Whether a short in the fire switch 212 is present or not is communicated to the user interface device 50.

Next, the arm switch is turned off (at 312), and the fire switch 212 is turned on. This is to detect if a short exists in the arm switch 210, which is accomplished by detecting (at 314) the current level in the cable 64. Whether a short is present or not in the arm switch 210 is communicated to the user interface device 50. In some tests, both the arm switch 210 and fire switch 212 can be turned on to detect for the presence of a detonating device. If the detonating device is present, then a first current level is detected. If the detonating device is absent, then a different current level is detected.

In addition to detecting shorts, the test box 60 can also determine if wires have been mis-connected. Mis-wiring will cause un-expected amounts of current to be detected by the test box 60.

Next, both the arm switch 210 and fire switch 212 are turned off, and the cable switch 18 is turned on (at 316). A predetermined increase in current is expected in response to activation of the cable switch 18. The increase in current is due to the additional load expected by addition of the next control unit I+1. The increase in current is detected by the tester box 60 (at 318). If the expected increase in current is not detected, then the cable switch 18 is deemed to be inoperational. The operational status of the cable switch 18 is communicated to the user interface device 50. The status of the switches 16 and 18 are stored in a switch status log 508 (FIG. 18) in the user interface device 50.

The tester box 60 then determines if the end of the multi-tool string has been reached (at 320). If not, the value of I is incremented (at 322), and the next control unit I is tested (302–318). If the end of the multi-tool string has been reached (as determined at 320), then the test is completed.

Figure 7:
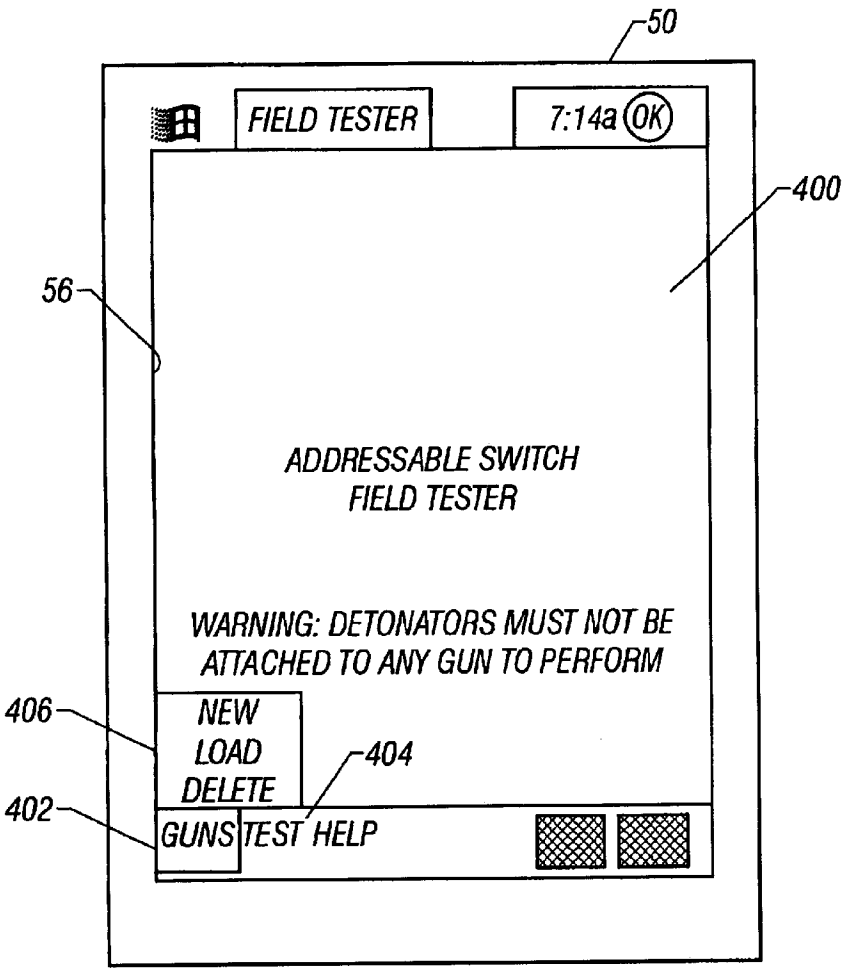

In one example embodiment, FIG. 7 shows a GUI window 400 displayed in the display 56 of the user interface device 50. At the lower end of the GUI window 400 are several menus, including a Guns menu 402 and a Test menu 404. In the screen shot shown in FIG. 7, the Guns menu is selected so that a frame 406 is displayed that includes a New menu item, a Load menu item, and a Delete menu item.

Figure 8:
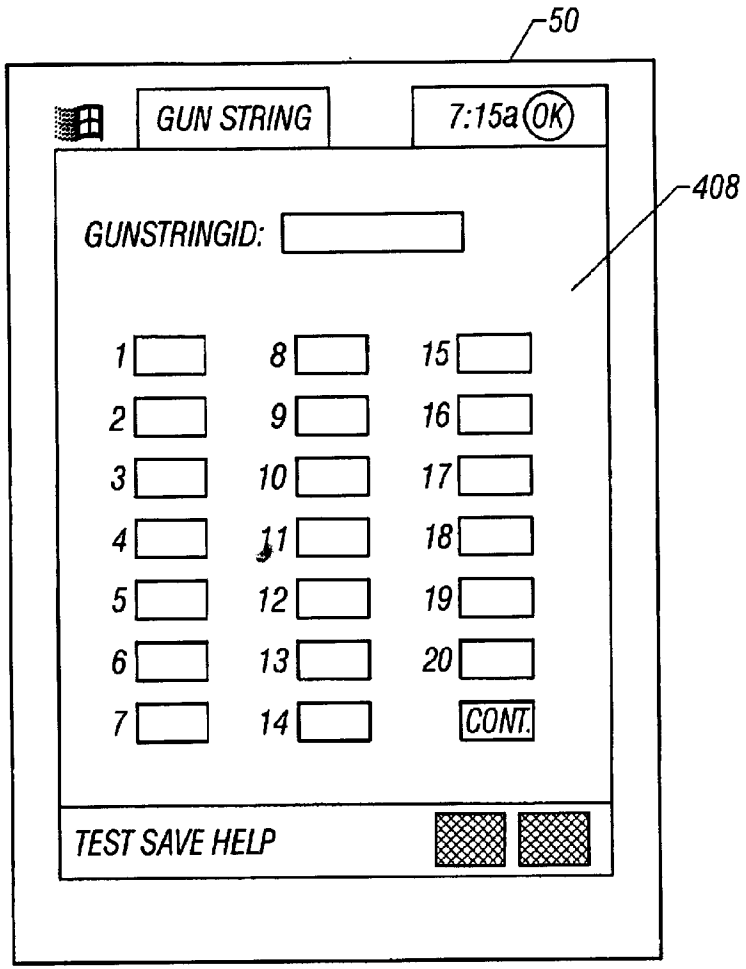
FIGS. 7–16 illustrate graphical user interface screens displayable by a user interface device in the tester system of FIG. 2.

When activated, the New menu item causes the display of a blank gun string screen 408, as shown in FIG. 8. However, if the Load menu item is selected, then a dialog box is presented (not shown) in which a user can enter or select a file from which gun string information can be loaded. Activation of the Delete menu item causes a dialog box to be presented (not shown) to select a gun string file to delete.

Figure 9:
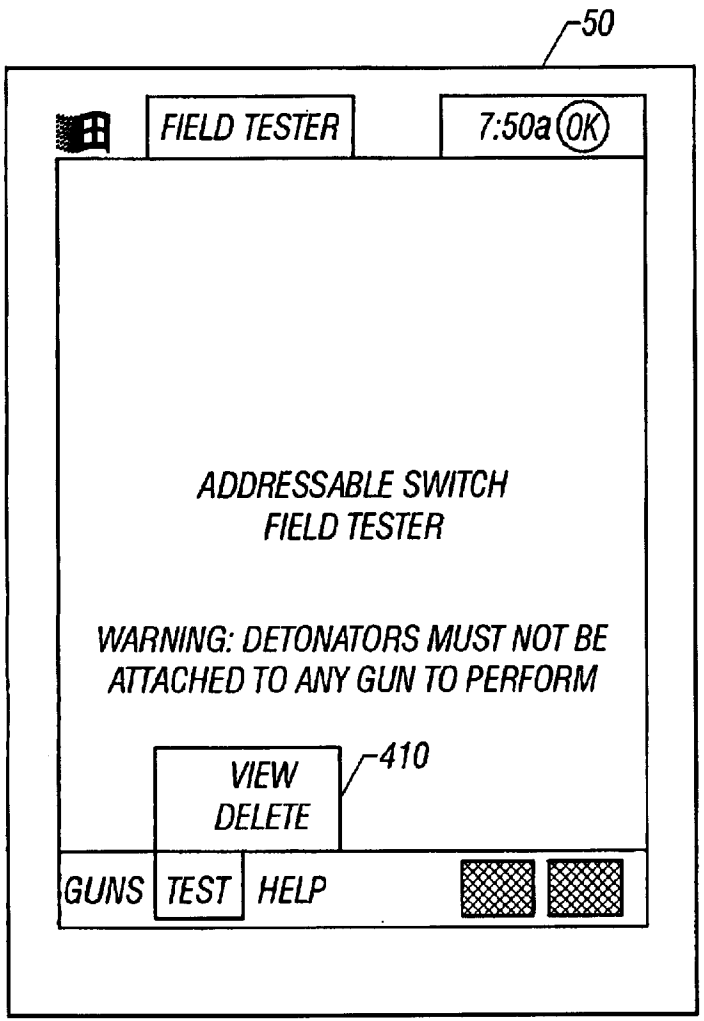

As shown in FIG. 9, activation of the Test menu 404 causes a frame 410 to be displayed. The Test menu frame 410 includes a View menu item and a Delete menu item. When activated, the View menu item opens a dialog box to select a test results file and causes the display of a test results screen to display the content of the test results file. When activated, the Delete menu item opens a dialog box to select a test results file to delete.

As noted above, FIG. 8 shows the gun string screen 408, which includes various display boxes. A GunStringID display box allows a user to enter an identifier of a specific gun string. More generally, GunStringID refers to any type of an identifier of tool. At a well site, many tools may be maintained. Unique identifiers are assigned to each of the tools so that inventory control is made possible.

In addition to the GunStringID display, other display boxes allow information to be displayed regarding components in the tool under test. If the tool under test is a perforating gun string, then plural control units may be present in the gun string. Each display box (labeled 1–20) corresponds to a respective control unit.

Figure 10:
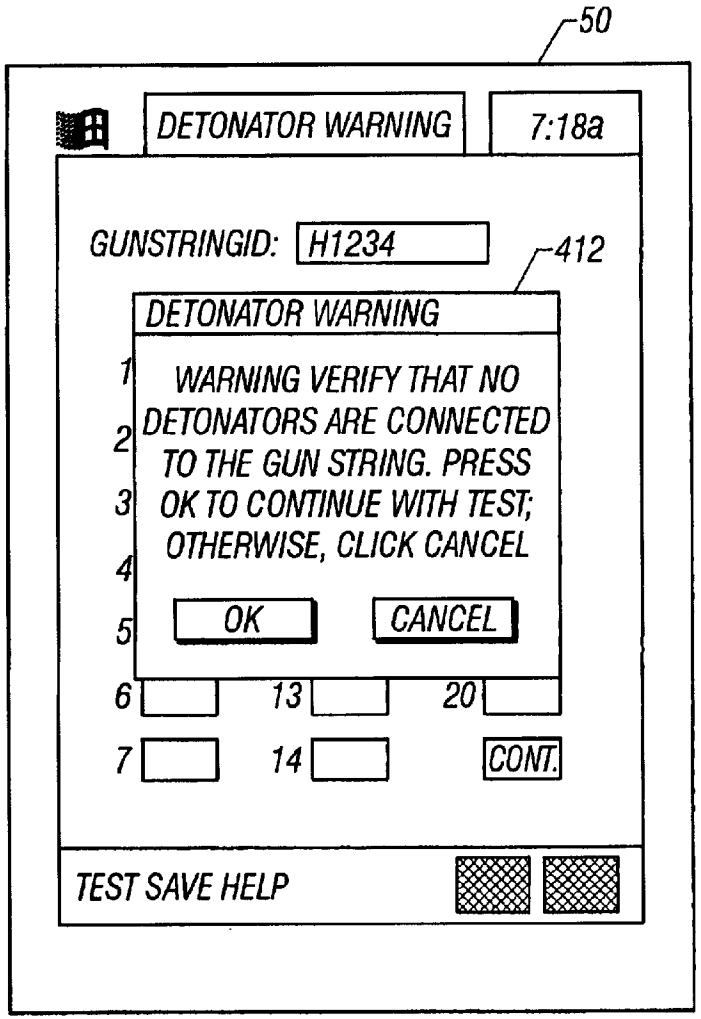

As shown in FIG. 10, a user has entered a GunStringID in the GunStringID display box. A dialog screen 412 is displayed to warn the user to verify that no detonators are connected to the gun string. The OK button is pressed by the user upon verification.

Figure 11:
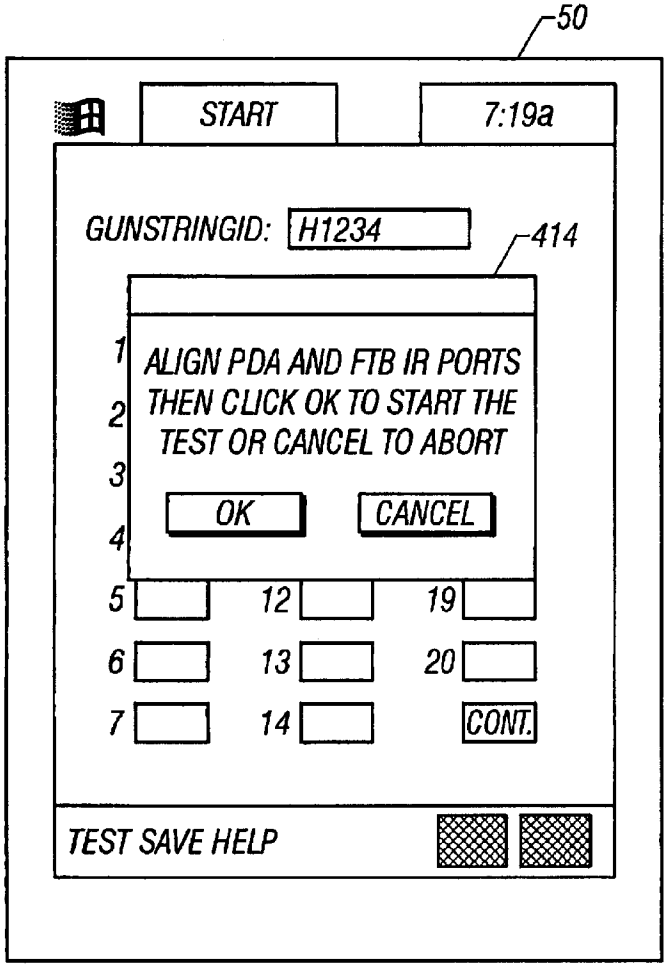

Next, as shown in FIG. 11, another dialog screen 414 is presented to instruct the user to align the ports 52 and 54 (FIG. 2) of the user interface device 50 and the tester box 60. Alignment is necessary when the wireless communications medium is an infrared medium. Alignment may not be necessary if radio frequency (RF) signaling is used. Once the ports 52 and 54 are aligned, the user selects the OK button in the dialog screen 414.

Figure 12:
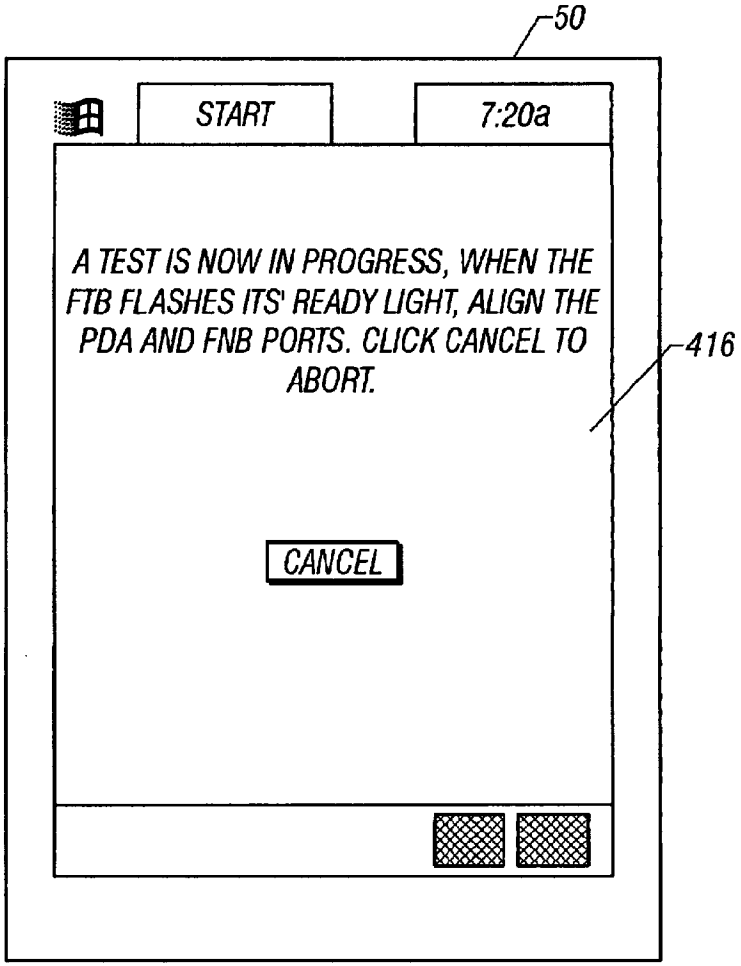

This starts the test operation discussed above. A status screen 416 is displayed, as shown in FIG. 12. A Cancel button is provided to enable the user to cancel the test operation if desired.

Figure 13:
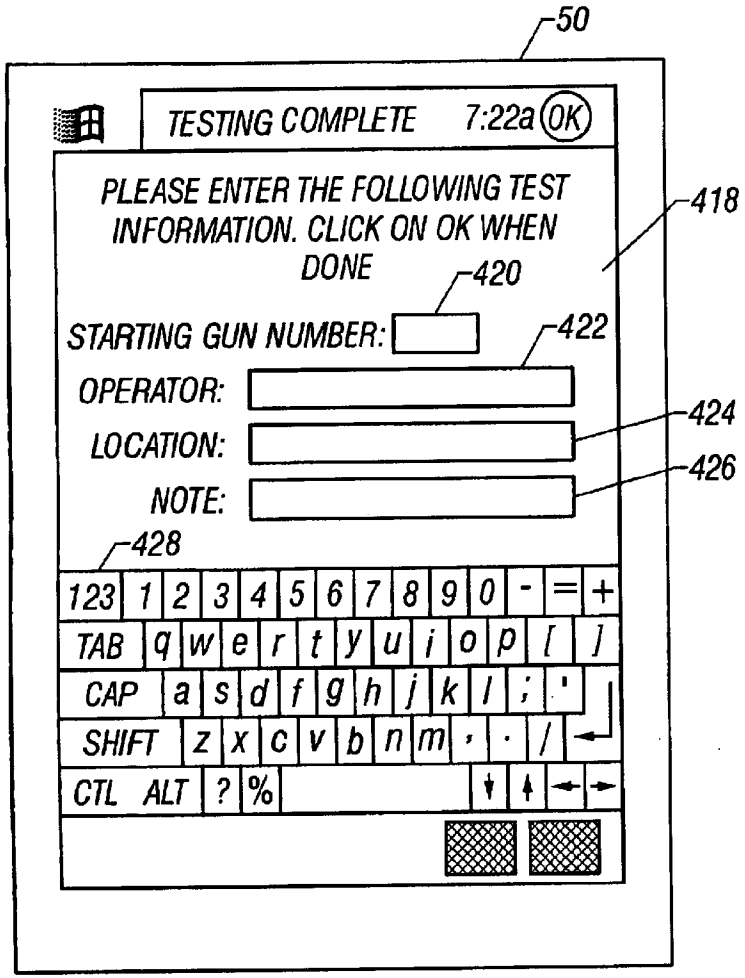

When testing is complete, a screen 418 is displayed, as shown in FIG. 13. The user is instructed to enter the starting gun number in a field 420, the operator name in a field 422, a test location in a field 424, and a note in a field 426. In accordance with one embodiment of the invention, a keyboard 428 is displayed in the screen 418 to enable the user to conveniently enter information in the fields 420, 422, 424 and 426.

Figure 14:
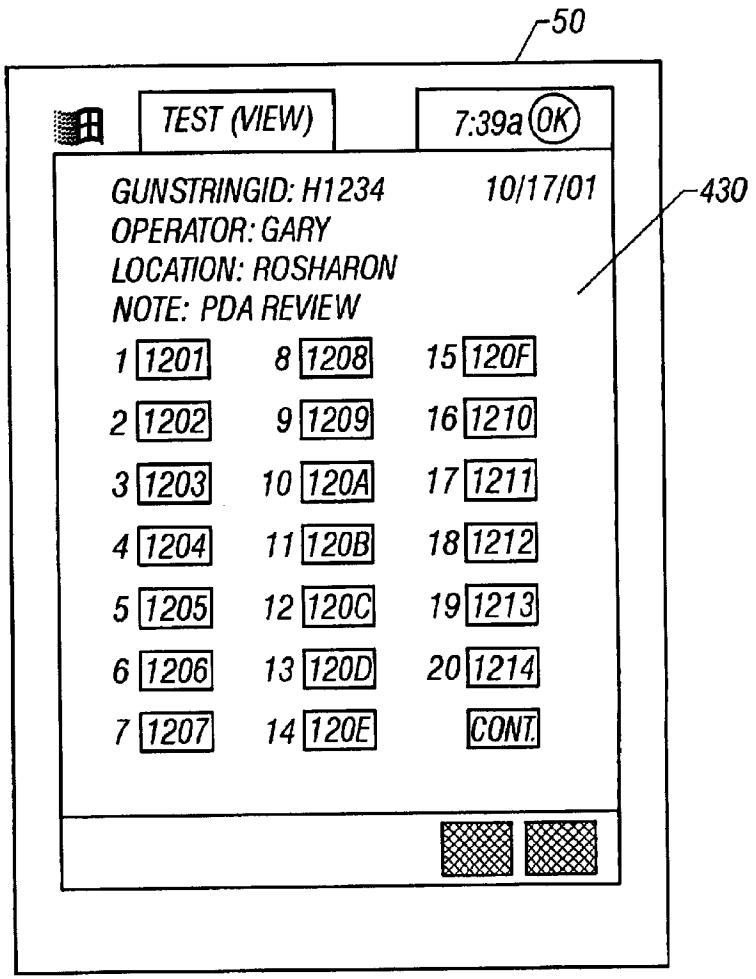
Figure 15:
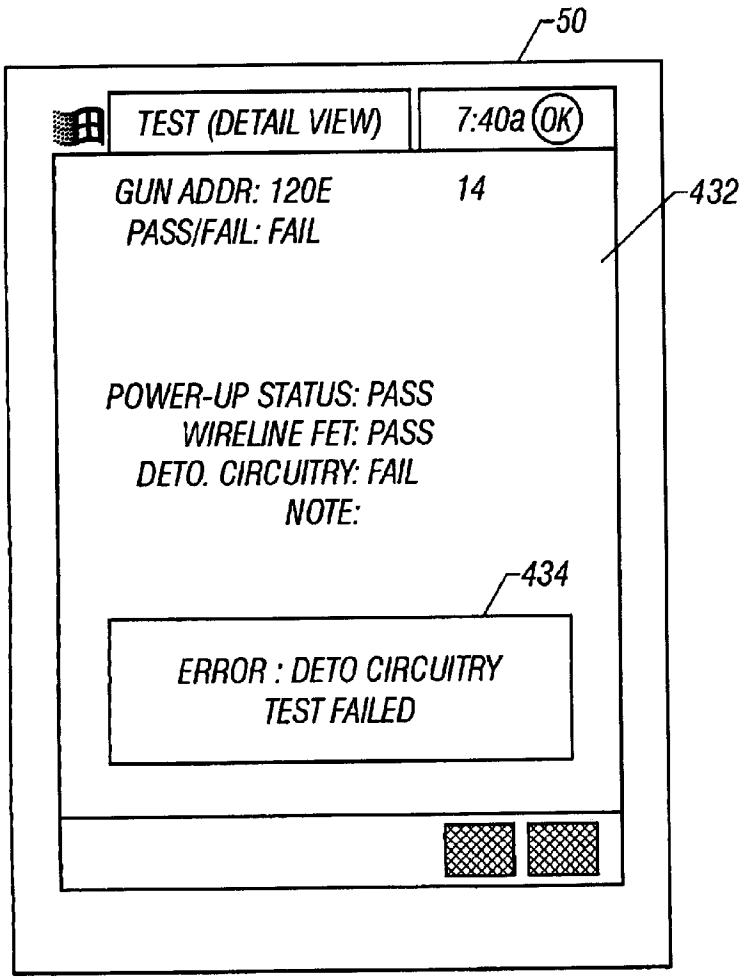

Next, as shown in FIG. 14, a Test View screen 430 is displayed. The addresses associated with the various control units in the gun string are displayed. As further shown in FIG. 14, a control unit 14 having identifier 120E is selected by the user to find out more information pertaining to the control unit. The information about the selected control unit is displayed in a screen 432 shown in FIG. 15. In the screen 432, the gun address is provided, along with a pass/fail status. In the example of FIG. 15, the control unit with address 120E has failed. The address of the failed control unit is highlighted (e.g., with a different color or some other indication). The screen 432 shows whether the power-up status has passed, whether the cable switch 18 has passed, and whether the detonation circuitry (including the detonator switch 16) has passed. In the example of FIG. 14, the detonation circuitry is indicated as being failed. A box 434 displays a message indicating failure of the detonation circuitry.

Figure 16:
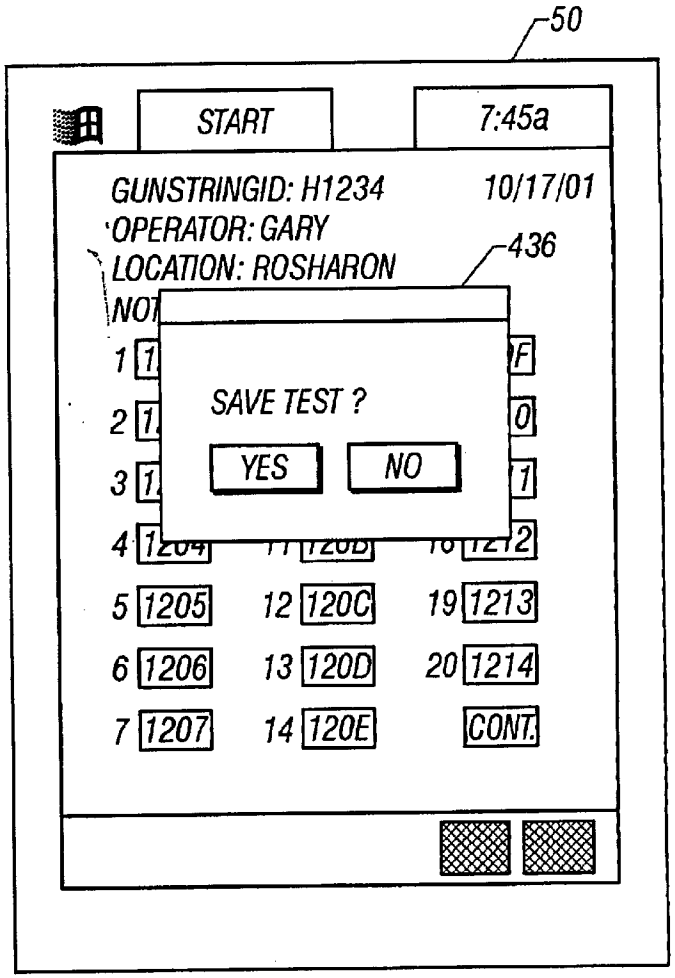

FIG. 16 shows a dialog screen 436 that allows the user to save the test. This allows a user to later access the test results for display. Also, the saved test results can be communicated to another system (such as to another user).

Figure 17:
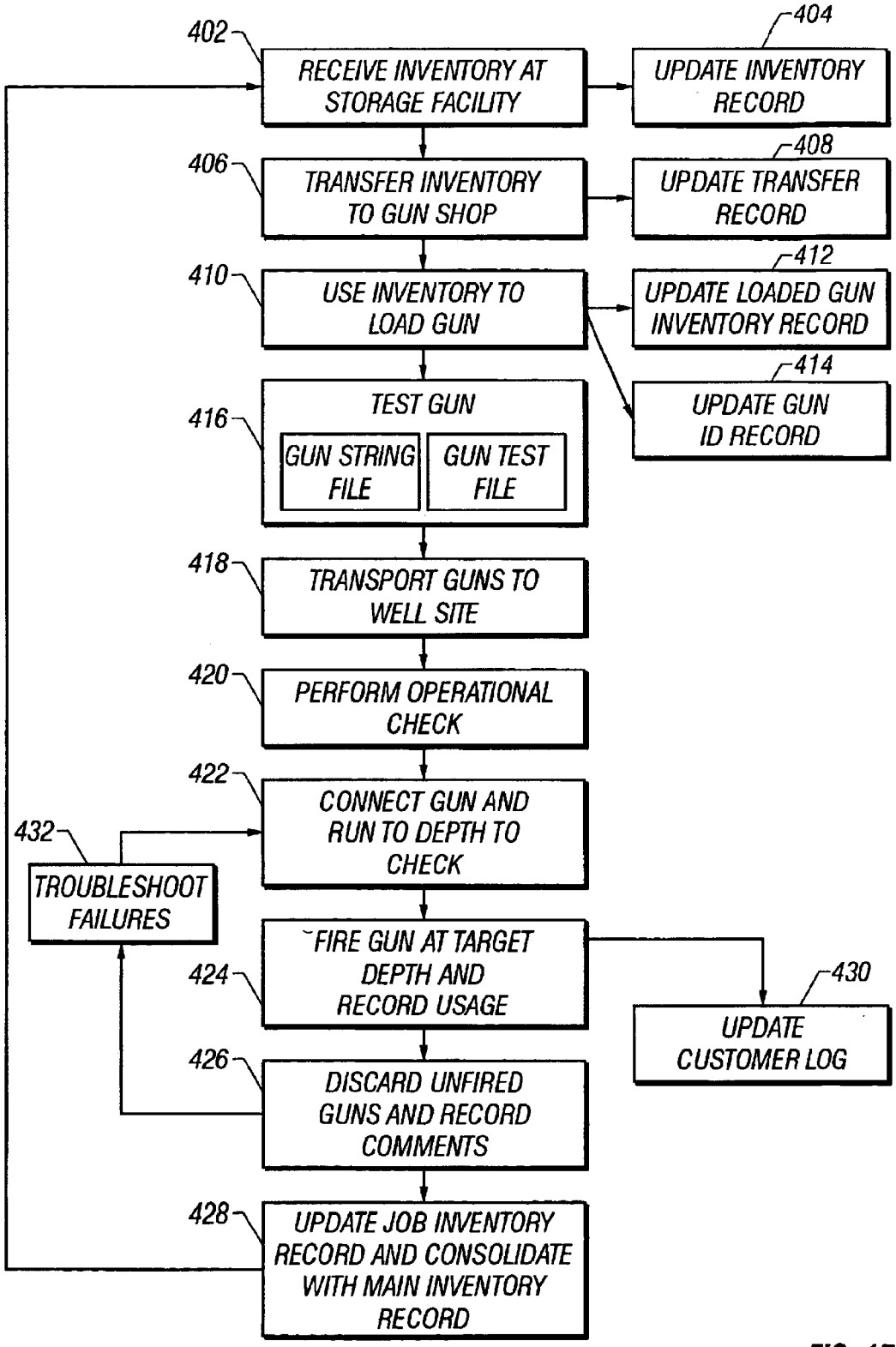
FIG. 17 is a flow diagram of a general sequence for operating a tool.

FIG. 17 shows a general process in accordance with an embodiment of the invention. As inventory is received at a storage facility, an identifier of the inventory is determined (at 402). In one embodiment, the identifier of the inventory is scanned with a scanner module 51 (FIG. 2) that is attached to the user interface device 50. In one embodiment, each component has a bar code associated with it. The bar code is scanned in by the scanner module 51 (as noted above). In some cases, the bar code of each control unit 14 can also be used as the address of the control unit 14. The bar codes of the various components may be easily scanned while the components are still in their container. Alternatively, each component can include an RF transceiver to interact with a scanner module that also includes an RF transceiver. The RF transceivers are able to communicate with each other without the container even having to be opened. This enables even more convenient scanning of identifiers of the components.

In another embodiment, another method of determining the identifier of the inventory can be performed. For example, the user can manually enter the serial number or other identifier of the inventory into the user interface device 50.

In one example, the inventory includes explosive components, such as detonator devices 22 (FIG. 1) and associated control units 14 and switches 16 and 18. In other examples, other types of inventory are involved. Generally, the "inventory" considered here includes components of various types of tools.

An identifier of the inventory, along with the description of the inventory, is stored (at 404) in an inventory record 510 (FIG. 18) in the user interface device 50. It may be desired to move the inventory around for performing various tasks. For example, if the inventory includes explosive components, control units, and switches for a perforating tool, the components may be transferred to a gun shop for loading. In this case, the identifier of the transferred inventory is determined (at 406), such as with the scanner module 51, and a transfer record is updated (at 408). The transfer record is stored in the user interface device as 512 (FIG. 18).

As explosive components are loaded into each gun, the loaded components are identified (at 410), such as with the scanner module 51. A loaded gun inventory record (or gun string file) 514 (FIG. 18) is updated (at 412) to indicate what components are in each gun. Also, a gun identifier record 516 (FIG. 18) is updated (at 414) to record the guns that have been made up at a particular site.

Next, the control units in each gun are tested (at 416) using the tester system described above. Note that the detonator device 22 may be left out of the tool string during testing. The results of the test are stored in the user interface device 50. After successful testing, the gun(s) are transported to a well site with a hard and/or soft copy of the loaded gun inventory record 514, gun string file, and gun test file.

Next, an operational check is performed at the well site and compared to the gun shop test (at 420). The gun string is then connected to the wireline or other carrier, and run into the well. At a safe depth, the switches are checked (at 422). The gun string is then lowered to a target depth and fired (at 424). The usage is recorded and exported to the user interface device 50. The gun usage information is stored in a gun usage record 518. Any un-fired guns are disarmed (at 426). A comment about each gun is recorded in the user interface device 50 (also in the record 518). A customer log 520 (FIG. 18) of the job is also maintained (at 430) for later viewing. Any failures in the gun string can be trouble shooted (at 432) at this point using the information stored in the user interface device 50. Optionally, the customer log 520 can also be inputted to a service order (e.g., an invoice).

A job inventory record 522 (FIG. 18) in the user interface device 50 is updated (at 428) and consolidated with a main inventory record 524. The job inventory record 522 indicates what inventory was used in the job. The main inventory record 524 keeps track of all inventory used over some period of time (e.g., days, weeks, months, years).

Although various logs and records are shown as being stored in the user interface device 50, other embodiments may store other arrangements and combinations of logs and records. Note that the various logs and records can be presented on a display or printed for viewing.

FIG. 18 shows various components of the user interface device 50. The arrangement shown in FIG. 18 is provided as an example only, as other embodiments can include other arrangements. As noted in connection with FIG. 2, the user interface device 50 includes the display 56 and graphical user interface screens 58 that are displayable in the display 56. The user interface device 50 also includes a processor 500 that is coupled to a storage 502. One or more applications are executable on the processor 500. One of the software applications is a tool control application 530 that is used for controlling various types of communications with a tool. For example, in one embodiment, the tool control application 530 is responsible for communicating with the tester box 60 (FIG. 2) for performing various test tasks. In other embodiments, the tool control application 530 is able to perform other control tasks.

The storage 502 stores various data, including the address log 506, switch status log 508, inventory record 510, transfer record 512, loaded gun inventory record 514, gun identifier record 516, gun usage record 518, customer log 520, job inventory record 522, and main inventory record 524. Other information can also be stored in the storage 502.

The processor 500 is also coupled to a wireless interface 504 that is coupled to the wireless port 52. In one embodiment, the wireless interface 504 is an infrared interface for communicating infrared signals. In other embodiments, the wireless interface 504 is capable of performing other types of a wireless communications, such as radio frequency communications.

The user interface device 50 also includes an input/output (I/O) interface 526 for connection to various types of peripheral devices through a port 528. One such peripheral device is the scanner module 51 (FIG. 2).

In response to user selection in the GUI screens 58, the tool control application 530 is invoked. The tool control application 530 controls the presentation of screens and information in the screens 58, depending on what user selections are made. Also, in response to the user selections, the tool control application 530 controls the transmission of commands to an external device, such as the tester box 60, through the wireless interface 504 and the port 52.

Figure 19:
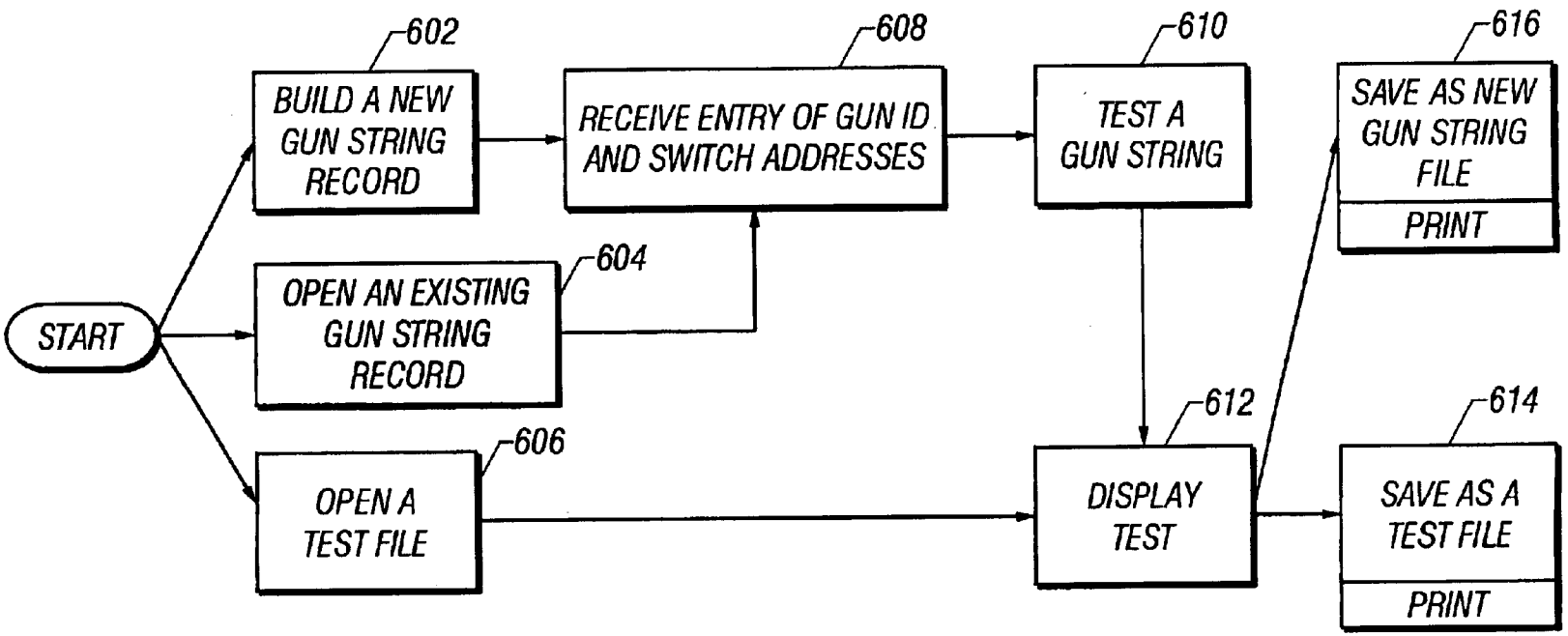
FIGS. 19–22 are flow diagrams of processes performed by the user interface device.

Referring to FIG. 19, a basic flow diagram of tasks performed by the tool control application 530 in the user interface device 50 is illustrated. Depending on what user selection is made in the GUI screens 58, the tool control application 530 performs one of the following tasks: build (at 602) a new gun string record; open (at 604) an existing gun string record; or open (at 606) a test results file. Selection of one of the tasks 602 and 604 is performed from the Guns menu 402 shown in FIG. 7. Opening a test file 606 is performed by selecting the View menu item from the Test menu 410 (FIG. 9).

To build a new gun string record or to open an existing gun string record, the tool control application 530 receives (at 608) the entry or editing of the gun identifier (GunStringID) and switch addresses. Next, in response to user selection to begin a test, the tool control application 530 begins the test sequence of the gun string (at 610). From either 610 or 606, the tool control application 530 displays the test results (at 612). In response to user command, the tool control application 530 is able to save the test results into a test results file (at 614) or to save the gun string record (at 616) for later access.

Figure 20:
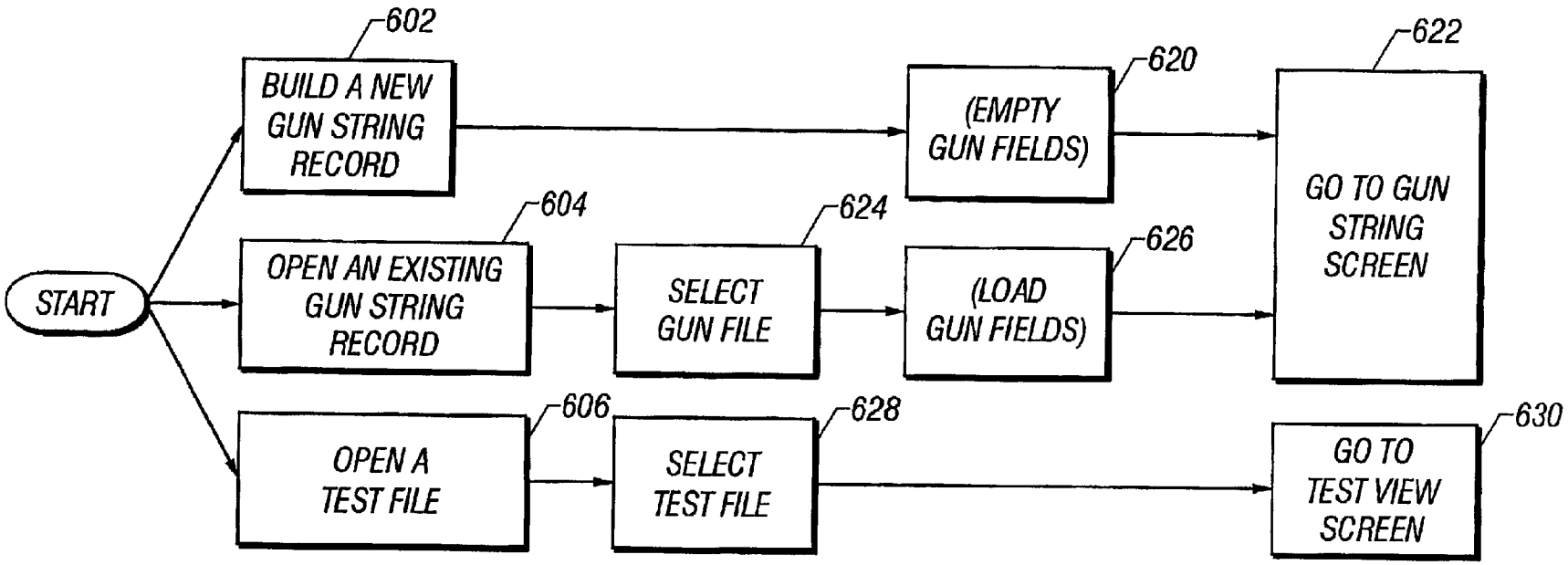

As further shown in FIG. 20, additional tasks are performed by the tool control application 530 depending on which one of the tasks 602, 604, and 606 has been selected by the user. To build a new gun string record, the tool control application 530 passes empty gun fields (at 620) to the Gun String screen 408 shown in FIG. 8. The tool control application 530 then causes (at 622) the Gun String screen 408 to be displayed.

If the selected task is to open an existing gun string record, then an existing gun file is selected (at 624) by the tool control application 530. The gun fields from the gun file are loaded (at 626), and displayed in the Gun String screen (at 622).

If the selected task is to open a test file, then a test file is selected (at 628). The Test View screen is displayed (at 630) to present the test results, as shown in FIG. 14.

Figure 21:
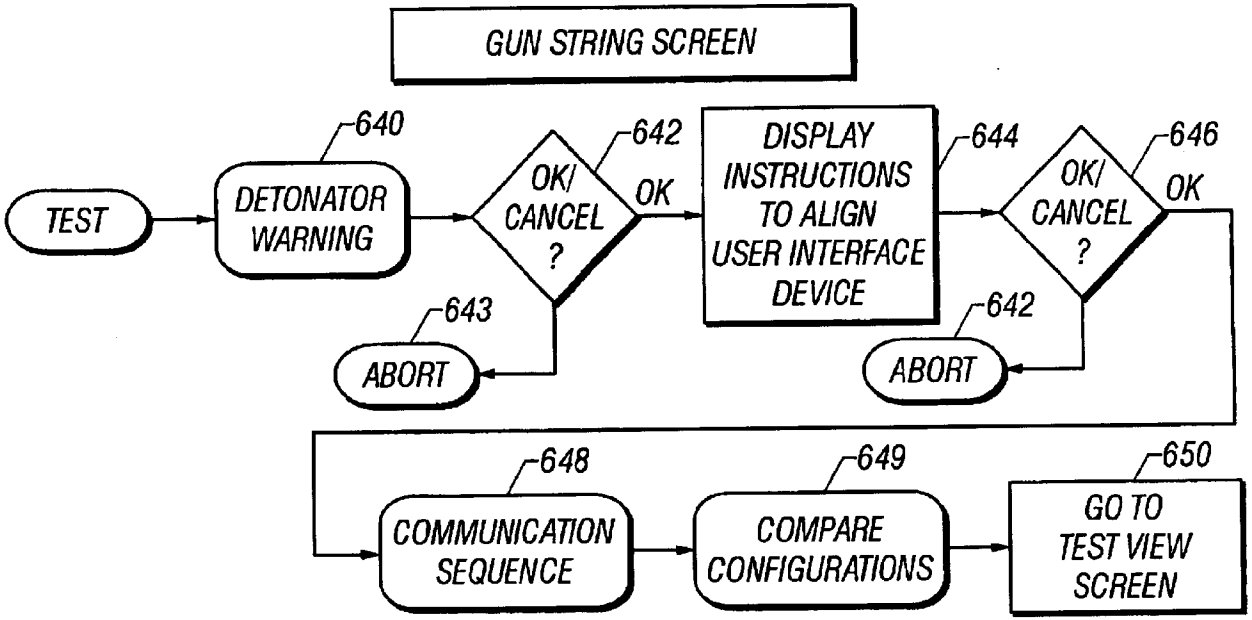

FIG. 21 shows other tasks performed by the tool control application 530 in a tool test sequence. First, a detonator warning is presented (at 640). This is shown in the dialog screen 412 in FIG. 10. The tool control application 530 then determines (at 642) if the user has selected the OK or Cancel button. If the Cancel button is activated, then the test sequence is aborted (at 643). However, if the OK button is activated, the tool control application 530 causes (at 644) the display of the dialog screen 414 (FIG. 11) to instruct a user to align the user interface device 50 with the test box 60. Next, the tool control application 530 determines (at 646) if the OK button or the Cancel button has been activated. If the Cancel button has been activated, then the test sequence is aborted (at 647). However, if the OK button has been activated, the tool control application 530 starts the communication sequence (at 648). The communication sequence involves the transmission of commands to the tester box 60 to start testing the various components of the tool string, including the control units 14 and switches 16 and 18. The tool control application 530 also determines (at 649) if the configuration in the gun string file or loaded gun inventory record 514 (FIG. 18) matches the detected configuration. The tool control application 530 marks a mismatch as being a failure.

The results of the test sequence are provided to the Test View screen (at 650), with the results displayed. The Test View screen 430 is shown in FIG. 14.

Figure 22:
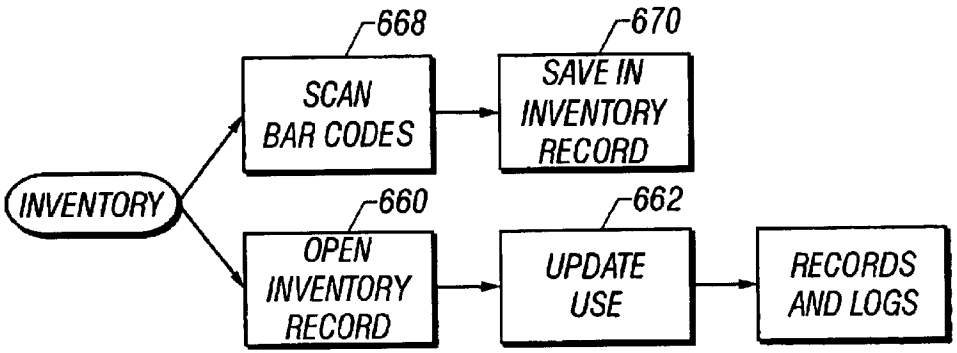

In accordance with some embodiments, an additional or alternative feature of the tool control application 530 is inventory control. As shown in FIG. 22, the tool control application 530 receives (at 660) an inventory file to open. The inventory file includes the inventory record 510. In response to usage, various logs and records can be updated (at 662), including the customer log 520, transfer record 512, loaded gun inventory record 514, gun usage record 518, job inventory record 522, and main inventory record 524. Usage is described above in connection with FIG. 17.

Another feature offered by the user interface device 50 is the ability to scan inventory (at 668), such as bar codes of detonator devices, control units, and switches. The scanned identifiers are saved in the inventory record 510 (at 670). Also, for correlation purposes, the distance of shots, in relation to casing collar locators, can also be input to the user interface device. Furthermore, information collected by a core sampling tool can be stored in the user interface device. The core sampling tool collects information in the wellbore. After the core sampling tool is retrieved to the surface, the user interface device communicates with the core sampling tool to receive and store the collected information.

Instructions of the various software routines or modules discussed herein (such as those in the user interface device 50 and tester box 62) are stored on one or more storage devices in corresponding devices and loaded for execution on corresponding control units or processors. The control units or processors include microprocessors, microcontrollers, processor modules or subsystems (including one or more microprocessors or microcontrollers), or other control or computing devices. As used here, a "controller" refers to hardware, software, or a combination thereof. A "controller" can refer to a single component or to plural components (whether software or hardware).

Data and instructions (of the various software routines or modules) are stored in respective storage units, which are implemented as one or more machine-readable storage media. The storage media include different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; and optical media such as compact disks (CDs) or digital video disks (DVDs).

The instructions of the software routines or modules are loaded or transported to each device in one of many different ways. For example, code segments including instructions stored on floppy disks, CD or DVD media, a hard disk, or transported through a network interface card, modem, or other interface device are loaded into the device or system and executed as corresponding software modules or layers. In the loading or transport process, data signals that are embodied in carrier waves (transmitted over telephone lines, network lines, wireless links, cables, and the like) communicate the code segments, including instructions, to the device. Such carrier waves are in the form of electrical, optical, acoustical, electromagnetic, or other types of signals.

While the invention has been disclosed with respect to a limited number of embodiments, those skilled in the art, having the benefit of this disclosure, will appreciate numerous modifications and variations therefrom. It is intended that the appended claims cover such modifications and variations as fall within the true spirit and scope of the invention.

What is claimed is:

1. A system, comprising:

a portable user interface device;

a control module; and a tool selected from the group consisting of a well tool and a tool containing one or more explosive elements, the tool coupled to the control module, the portable user interface device adapted to communicate wirelessly with the control module, wherein the control module is adapted to send a command to the tool to perform a test of the tool, wherein the control module is responsive to wireless signals from the portable user interface device to send coded signals to the tool for testing the tool, the control module comprising a detector adapted to detect a status of one or more components of the tool, wherein the detector comprises a current detector adapted to detect a level of electrical current.

2. The system of claim 1, wherein the portable user interface device comprises a display to display a graphical user interface.

3. The system of claim 2, wherein the graphical user interface comprises one or more graphical elements selectable to control the tool.

4. The system of claim 3, wherein the portable user interface device comprises an infrared transceiver adapted to communicate infrared signals.

5. The system of claim 1, wherein the portable user interface device comprises a personal digital assistant.

6. The system of claim 1, wherein the user interface device comprises a display to show a result of the test.

7. The system of claim 1, wherein the tool comprises plural control units, the user interface device adapted to send commands to the tool to successively test the plural control units.

8. The system of claim 7, wherein the tool comprises a string of elements, and the control module is coupled to the string of elements.

9. The system of claim 1, wherein the portable user interface device comprises a graphical user interface having one or more control elements selectable to activate testing of the tool.

10. The system of claim 9, wherein the tool comprises plural control units, the portable user interface device adapted to send commands to sequentially test the plural control units.

11. The system of claim 10, wherein the graphical user interface is adapted to display acquired information pertaining to each of the control units.

12. The system of claim 9, wherein the graphical user interface is adapted to display information pertaining to control units for explosive devices.

13. The system of claim 1, wherein the portable user interface device is adapted to check that communications with components of the tool is functional.

14. The system of claim 13, wherein the portable user interface device is adapted to verify addresses of the components in the tool.

15. A system, comprising:

a portable user interface device;

a control module; and a tool selected from the group consisting of a well tool and a tool containing one or more explosive elements, the tool coupled to the control module, the portable user interface device adapted to communicate wirelessly with the control module, wherein the control module further comprises a current detector to detect current from the tool, the control module adapted to use an output of the current detector to determine for presence of components in the tool.

16. The system of claim 15, wherein the control module is adapted to further use the output of the current detector to determine if a component of the tool has failed.

17. The system of claim 15, wherein the control module is adapted to communicate an operational status of each of the components to the portable user interface device.

18. The system of claim 17, wherein the portable user interface device has a graphical user interface to display the operational status of each of the components in the tool.

19. A system, comprising:

a portable user interface device;

a control module; and a tool selected from the group consisting of a well tool and a tool containing one or more explosive elements, the tool coupled to the control module, the portable user interface device adapted to communicate wirelessly with the control module, wherein the control module further comprises a current detector to detect current from the tool, the control module adapted to use an output of the current detector to determine if a component in the tool has failed.

20. The system of claim 19, wherein the control module is adapted to communicate an operational status of each of the components to the portable user interface device.

21. The system of claim 20, wherein the portable user interface device has a graphical user interface to display the operational status of each of the components in the tool.

22. A system, comprising:

a portable user interface device;

a control module; and a tool selected from the group consisting of a well tool and a tool containing one or more explosive elements, the tool coupled to the control module, the portable user interface device adapted to communicate wirelessly with the control module, wherein the control module is adapted to send a command to the tool to perform a test of the tool, wherein the control module is responsive to wireless signals from the portable user interface device to send coded signals to the tool for testing the tool, the control module comprising a detector adapted to detect a status of one or more components of the tool, wherein the detector is adapted to detect for at least one of the following failures: mis-wiring of a components in the tool; a short in the tool; and the presence of a detonator in the tool.

* * * * *

UNITED STATES PATENT AND TRADEMARK OFFICE

CERTIFICATE OF CORRECTION

PATENT NO. : 6,938,689 B2
DATED : September 6, 2005
INVENTOR(S) : Farrant et al.

It is certified that error appears in the above-identified patent and that said Letters Patent is hereby corrected as shown below:

Title page,
Item [75], Inventors, replace "Bookside" with -- Brookside --; and replace "Venersuo" with -- Veneruso --.
Item [73], Assignee, replace "Schumberger" with -- Schlumberger --.
Item [56], References Cited, OTHER PUBLICATIONS,
"H. R. James" reference, replace "Initatiation" with -- Initiation --.
Item [74], *Attorney, Agent, or Firm*, replace "Bruan" with -- Bryan --.

Signed and Sealed this

Seventh Day of February, 2006

JON W. DUDAS
*Director of the United States Patent and Trademark Office*